US005242218A

United States Patent [19]

Cota et al.

[11] Patent Number: 5,242,218

[45] Date of Patent: Sep. 7, 1993

[54] UNITIZED TELESCOPIC-LEG ASSEMBLY

[76] Inventors: Albert O. Cota, 17475 Flanders St., Granada Hills, Calif. 91316; William M. Kitner, 4425 Palos Verdes Dr., North, Rolling Hills Estates, Calif. 90274

[21] Appl. No.: 834,223

[22] PCT Filed: Jun. 28, 1990

[86] PCT No.: PCT/US90/03603

§ 371 Date: Feb. 10, 1992

§ 102(e) Date: Feb. 10, 1992

[51] Int. Cl.[5] ..... A47B 95/02

[52] U.S. Cl. ..... 312/244; 248/461

[58] Field of Search ..... 248/461, 164, 170, 171, 248/166, 165; 108/159; 190/11, 900; 312/231, 244

[56] References Cited

U.S. PATENT DOCUMENTS

| | | | |
|---|---|---|---|
| 1,081,221 | 12/1913 | Durkin . | |
| 1,449,023 | 3/1923 | Wardle | 248/170 X |
| 2,324,439 | 7/1943 | Thommen | 248/96 |
| 2,425,196 | 8/1947 | Lopes | 248/170 X |
| 2,759,576 | 8/1956 | Towsend . | |
| 3,309,049 | 3/1967 | Albee | 248/171 |
| 4,034,518 | 7/1977 | Trecker . | |
| 4,244,632 | 1/1981 | Molinari | 312/231 |
| 4,412,604 | 11/1983 | Bell . | |
| 4,790,416 | 12/1988 | Baker . | |
| 4,854,652 | 8/1989 | Ahmann | 312/244 X |
| 4,856,627 | 8/1989 | Polatov . | |

FOREIGN PATENT DOCUMENTS

| | | | |
|---|---|---|---|
| 581348 | 11/1924 | France | 190/11 |

*Primary Examiner*—J. Franklin Foss
*Attorney, Agent, or Firm*—Albert O. Cota

[57] ABSTRACT

A unitized telescopic leg assembly (10) that is incorporated into one side of a hand carried case to allow the case to be propped upright in either an opened or closed configuration. The assembly (10) includes a U-shaped housing (22) mounted inside the briefcase and includes a pair of legs (30) which are slideably retained. A piston (54) is attached to the inside end of the legs permitting the legs to extend from the case slowly due to a slight vacuum formed inside the housing. A catch assembly consisting of a actuator (80) and contiguous rods (64) inside the housing retain the legs by the urging of the rods into a keeper (58) on each leg. When the actuator is manually depressed, the legs extend and when tilted open form a four leg stand. The legs are manually retracted and held in place by the arms interfacing with the keepers.

17 Claims, 3 Drawing Sheets

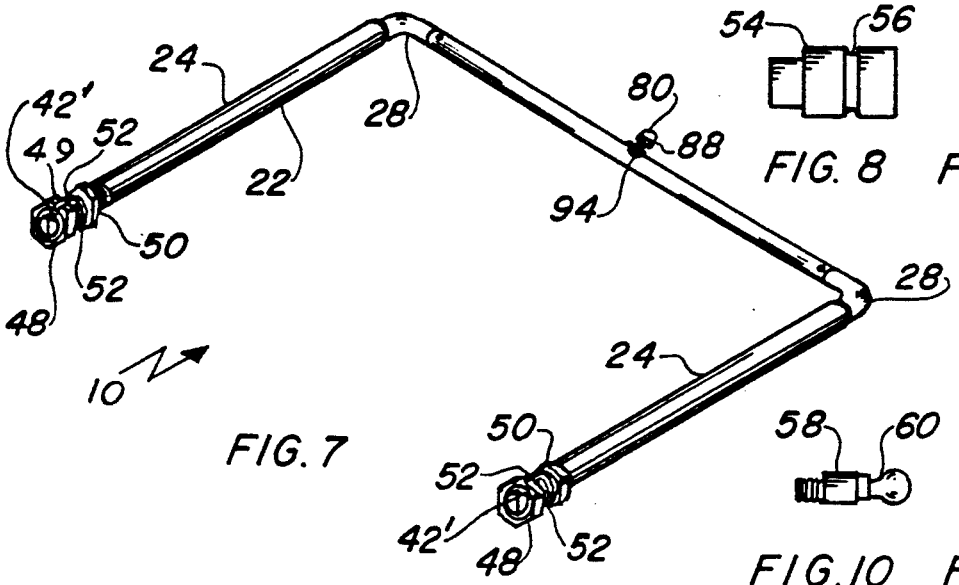
FIG. 7
FIG. 8
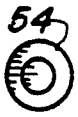
FIG. 9
FIG. 10
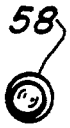
FIG. 11
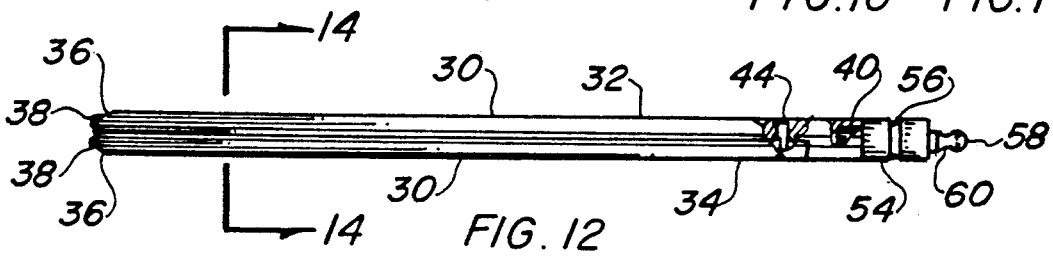
FIG. 12
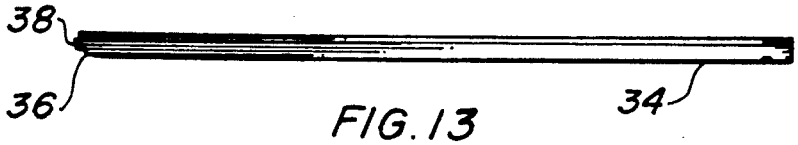
FIG. 13
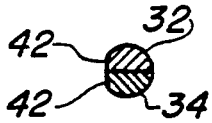
FIG. 14
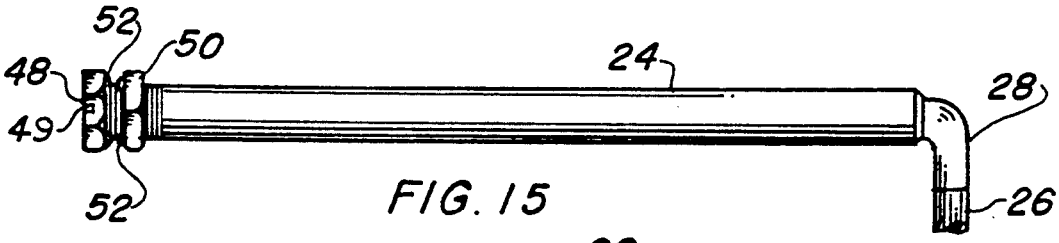
FIG. 15
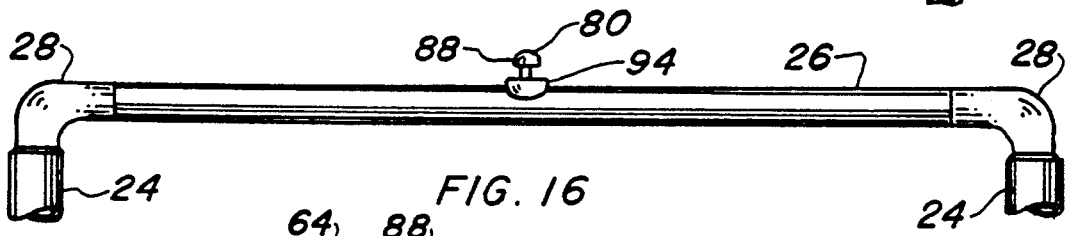
FIG. 16
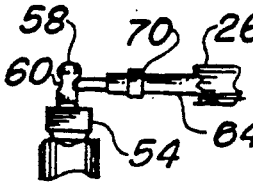
FIG. 17
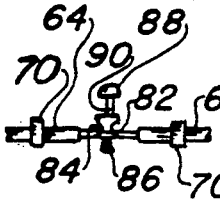
FIG. 18
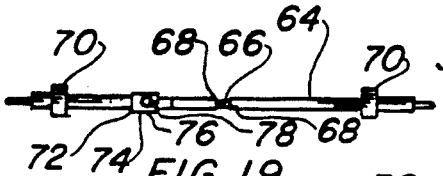
FIG. 19
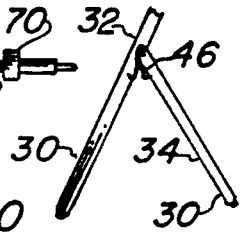
FIG20

UNITIZED TELESCOPIC-LEG ASSEMBLY

TECHNICAL FIELD

The invention pertains to the general field of hand carried cases such as briefcases, camera cases and the like and more particularly to cases incorporating a telescopic-leg assembly that allows the case to be propped upright in either an opened or closed configuration.

BACKGROUND ART

Conventional hand carried cases such as briefcases, camera cases, equipment cases and other utility cases are primarily designed to facilitate the storage and transporting of documents, supplies and other implements. In many situations, such as when in transit or when making presentations, a suitable table or structure, in which to place an open case, is not available. In these situations, the case must be placed on the floor or some other surface that is not conducive to protect the case from abrasions or contamination from floor debris. Additionally, when the case is placed on a low surface, the retrieval of the case contents is in many instances difficult and at best is cumbersome.

There have been attempts in the prior art to increase the utility of a case by incorporating into the case design, a set of foldable or telescoping legs. The foldable leg designs, aside from being bulky and unwieldy, greatly reduce the case's aesthetic appearance. The telescoping leg designs are complex in that several external and internal components are required for their operation. Additionally, the internal components reduce the carrying capacity of the case and several modifications must be made to the case structure to install and operate the prior art designs.

A search of the prior art did not disclose any patents that read directly on the claims of the instant invention, however, the following U.S. patents were considered related:

| U.S. Pat. No. | INVENTOR | ISSUED |
|---|---|---|
| 4,790,416 | Baker | 13 December 1988 |
| 4,412,604 | Bell, et al | 1 November 1983 |
| 4,034,518 | Trecker | 12 July 1977 |
| 2,522,322 | Wallace | 12 September 1950 |
| 837,855 | Goldin | 17 December 1907 |

The Baker patent, which is assigned to the applicants of the instant application, discloses a rigid carrying case, such as a briefcase, that includes a removable flat writing top that is attached when the case is opened. The invention also includes a set of four legs that when not in use, are stored within respective leg housings located within its case. Each leg is individually released from its housing by depressing a corresponding release button protruding outside the case. When the four legs have been extended, the case, while being held above a supporting surface, is opened allowing each pair of legs to cross. The crossed legs then support and allow the case to be propped upright in an open position.

The Bell patent discloses a combination luggage case and stand with an extension. The case has an openable top with a hinged cover and foldable legs. This folding structure includes a fork shaped support used as a table, and a second position raising the nose to be horizontal, forming an extension table.

ANALYSIS OF BAKER PATENT

An analysis of the BAKER patent and a prototype briefcase incorporating the telescopic legs of the BAKER patent disclosed the following:

1. Two separate telescopic leg assemblies are required. Therefore, both sides of the briefcase must be modified to install the two assemblies.
2. A total of 48 separate components are required for each briefcase which affects the briefcase reliability and increases assembly time.
3. A total of eight bores must be drilled in the briefcase. Each side requires two bores for the leg housings and two bores for the leg release buttons.
4. A total of four leg release buttons and release mechanisms are required. This many buttons makes it cumbersome to hold the briefcase while the buttons are being depressed to release the legs.
5. The attachment and adjustment of the four leg release mechanisms requires close manufacturing tolerances which adversely affect the manufacturing assembly rate.
6. After the legs are extended, the briefcase must be opened before it can be placed on a support surface.

END OF ANALYSIS

The Trecker patent discloses a portable cot and table that folds into a carrying case. Extensions are added to lengthen the structure, and the legs are added to the center bottom of the structure. The corner legs are hinged and swing into the case when not in use. All six legs are extendible to raise the height of the flat horizontal surface to enable the unit to be used as a table.

The Wallace patent discloses a bifurcated leg structure that optionally supports luggage sections in a horizontal position. The legs are removable and longitudinally adjusted by nesting together with sockets extending into the container without being in communication with the interior thereof. The legs may be used in triplicate in one of the two alternate positions, serving as a flat topped table with the container closed. A fourth leg is added when the container is opened flat.

The Goldin patent discloses a case that is provided with four collapsible legs formed of lengths of tube made to slide one within the other, the inner one being provided with a slot or groove, in which a stud or pin slides. The lower end of the slot being formed into a helical shape permitting the legs to be twisted reducing the width of the gap while increasing the friction, allowing the leg to stand by itself. The legs are stored within the case when telescoped together with only silver plated disks visible from the exterior, shaped so as to facilitate easy withdrawal and fixing.

DISCLOSURE OF THE INVENTION

With presently available hand-held cases and particularly expensive briefcases, users are at times reluctant to set the case on the floor or some other surface that may be dirty or have the ability to scratch or mar the finished exterior. Also, there are occasions when the user is placed in a situation where the interior of the case must be opened for access to the contents and no suitable surface is accessible for setting the briefcase. It is therefore a primary object of the inventive unitized telescopic leg assembly to provide an inherent set of telescopic legs within the case itself that may be lowered and opened by gravity permitting the case to be self supporting and stable, far enough above the surface to preclude damage. Further, the case may be opened and the interior exposed without disturbing the contents due to the angular attitude produced by the configuration of the legs allowing complete and convenient access.

An important object of the invention relates to a slow and even extending of the legs due to the use of a partial vacuum created within the leg housing when the legs are released. This action produces an impression that the movement is created by an intricate mechanism or actuators as the smoothness and quietness is conspicuously apparent. This object along with its utility conveys the attitude of quiet elegance to a briefcase particularly one of higher value.

Another object of the invention may be directed to the adaptation of a briefcase as a presentation stand for marketing. As the briefcase is retained at an angle and the lid may be opened, flip charts or visual displays may be easily attached and observed from either the interior or exterior as the case is stably positioned well above the floor.

Still another object of the invention is the ease of operation as the user simply pushes a single button near the handle and the legs distend automatically in a downward direction. When the legs are fully extended, the briefcase is raised at a slight angle to allow the legs to split with one half falling downward by gravity allowing the case to rest solidly on the floor. The case may then be opened, or it may be stored unopened with little space consumed and with far more stability than setting on the narrow bottom only. To retract the legs, the case is closed and lifted up allowing the split legs to mate with the rigid ones and then lowered to the floor causing the legs to retract unto the housing within the case. When the legs are fully retracted, the operating mechanism locks into the legs with a spring loaded catch. The legs may also be manually retracted one at a time if the occasion demands.

Yet another object of the invention deals with the unobtrusiveness of the briefcase modification. The only evidence from the outside is a button near the handle to activate the device and the leg ends with attaching caps on the bottom. In both areas they appear to match normal hardware found on similar briefcases and the button actuator is relatively small and in an alternate embodiment the button is recessed into the case itself. To the unknowing, the briefcase would not appear unusual in any way during its normal carrying mode.

A further object of the invention is the lightweight characteristic of the additional equipment added to the case. The apparatus includes only a pair of legs, housings and a catch mechanism with a pushbutton. These components are designed using lightweight material basically aluminum well known for its strength and lightness particularly in its high tensile heat treated configuration. Further, this material is easily and attractively finished with an integral chemical treatment to prevent corrosion such as hard anodizing which is inherent with the base metal and adds to its finished appearance.

A further object of the invention allows easy adaption to most common briefcases as the invention requires only two holes for the leg storing housings and a single hole for the actuator button. Any case that has a rectangular interior with a relatively flat or at least smooth surface on the button is a candidate for adapting the telescopic-leg assembly. The actual case material is of little concern as metal such as aluminum, thermoplastic, wood covered with plastic sheeting, fabric or leather combinations are equally well adapted to receive the assembly.

The telescopic-leg assembly is basically U-shaped with the case modified to receive the open ends with two simple holes through which the legs are inserted from the inside and held captive with a threaded cap on one side and a locknut on the other. The catch arrangement basically requires a hole through which the pushbutton actuator is inserted anchoring the device without the need of additional fasteners as the structural arrangement precludes the necessity of further fastening means. Little room is taken up inside the briefcase as the assembly is small and is nested in the inside corners out of the way leaving ample room for papers, files, publications, etc.

An additional object of the invention is to allow the case to be propped-up, by the assembly, before the case is opened or closed.

A final object of the invention allows the assembly to be installed by the original equipment manufacturer during the fabrication sequence or it may be added later after it is completed. Further, as only three holes are required for modification of the briefcase, this alteration may be accomplished by the manufacturer as an optional feature prior to shipment or the wholesaler, jobber, distributor or even the retailer may make the modification and install the assembly. The only limitation is the size as different manufacturers slightly change case dimensions which could easily be accommodated by a small number of alternate lengths and widths to fill the need. It is also possible to market the device to individual users for installation by the owner, again made possible by the minimal modification required to the briefcase.

These and other objects and advantages of the present invention will become apparent from the subsequent detailed description of the preferred embodiment and the claims taken in conjunction with the accompanying drawings.

BRIEF DESCRIPTION OF THE DRAWINGS

FIG. 7 is a partial isometric view of the invention completely removed from the briefcase for clarity.

FIG. 8 is a side view of the piston completely removed from the invention for clarity.

FIG. 9 is a end view of the piston completely removed from the invention for clarity.

FIG. 10 is a side view of the keeper completely removed from the invention for clarity.

FIG. 11 is a end view of the keeper completely removed from the invention for clarity.

FIG. 12 is a side view of the assembled leg completely removed from the invention for clarity.

FIG. 13 is a side view of the pivoted leg completely removed from the invention for clarity.

FIG. 14 is a cross-sectional view taken along lines 14—14 of FIG. 12 illustrating the cross section of the legs.

FIG. 15 is a fragmentary top view of the housings assembled together completely removed from the invention for clarity.

FIG. 16 is a fragmentary top view of the catch housing with elbows assembled and the push button actuator with the leg housings cut away.

FIG. 17 is a cutaway view of the end of the catch rod interfacing with the keeper and the housings cut away for visualization.

FIG. 18 is a cutaway view of the interface of the catch rods with the push button actuator and the housing cut away.

FIG. 19 is a side view of one of the catch rods completely removed from the invention for clarity.

FIG. 20 is a fragmentary view of the legs with the embodiment having a spring integral with the pivotal section allowing automatic opening of the legs when extended.

BEST MODE FOR CARRYING OUT THE INVENTION

Figure 2:
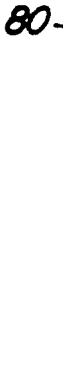
FIG. 2 is a cross-sectional view taken along lines 2—2 of FIG. 4 illustrating the interface of the case and catch.
Figure 1:
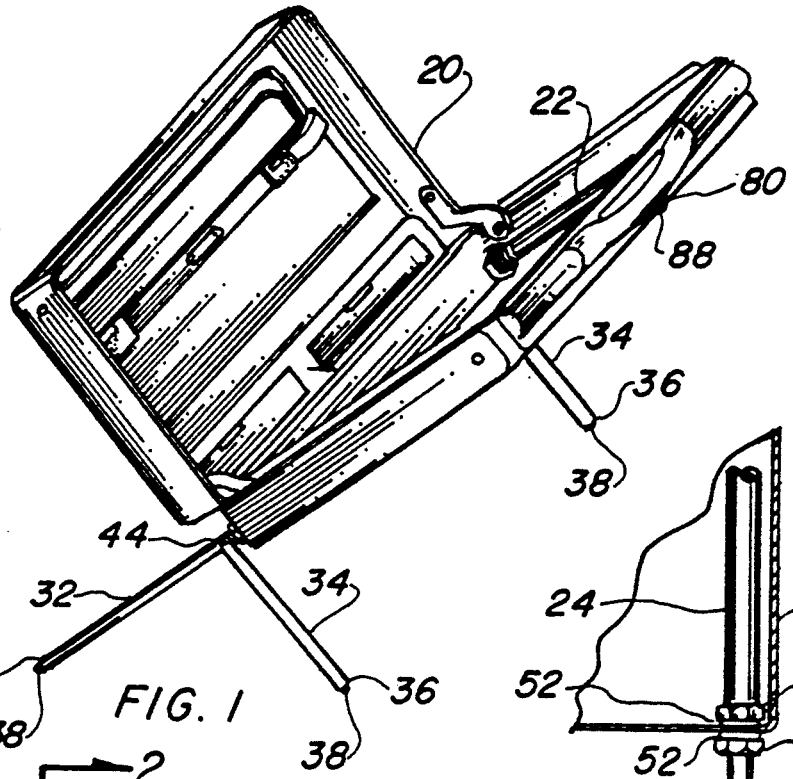
FIG. 1 is a partial isometric view of the preferred embodiment shown with the legs extended and the case opened exposing the inside.
Figure 3:
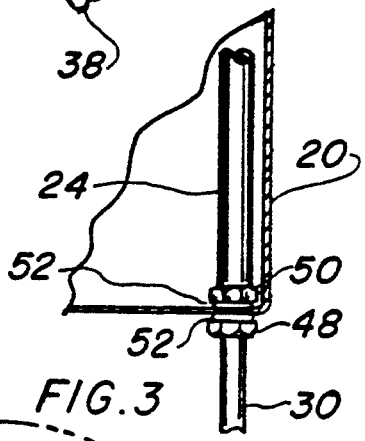
FIG. 3 is a cross-sectional view taken along lines 3—3 of FIG. 4 illustrating the interface of the housing and case.
Figure 4:
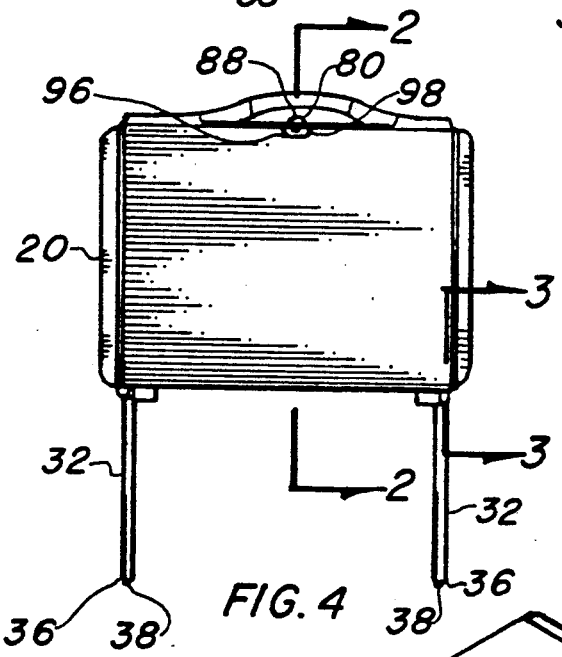
FIG. 4 is a side elevation view of the preferred embodiment with the legs extended.
Figure 5:
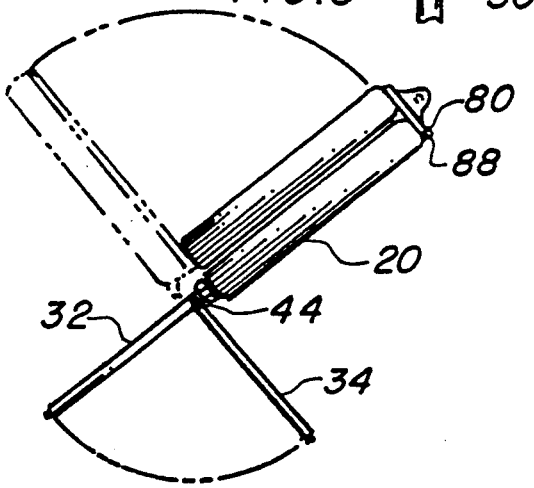
FIG. 5 is a end view of the preferred embodiment with the legs extended and the briefcase opened with the dashed lines indicating the direction of opening movement of the legs and case also the ability of the case to stand by itself unopened.
Figure 6:
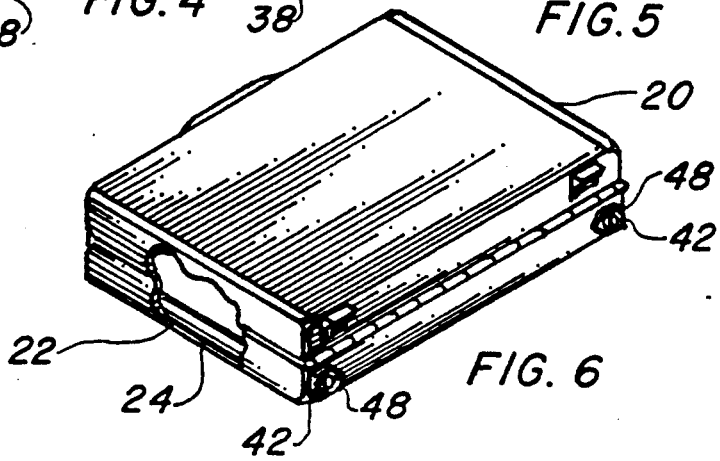
FIG. 6 is a partial isometric view of the preferred embodiment illustrated enclosed in the closed briefcase with only the ends of the legs visible.

The best mode for carrying out the unitized telescopic-leg assembly 10 is presented in terms of a preferred embodiment as shown in FIGS. 1 through 21. The assembly 10 is used to modify a hand carried case 20 that may be configured in any of its forms and particularly a briefcase having a handle and a hinge that allows the two sides of the case to be opened in a clam shell manner. One side of the case 20 is modified slightly with three holes drilled or punched in the vertical edges, two at the bottom as shown in FIGS. 3 and 6 and one in the top adjacent to the handle as illustrated in FIGS. 2 and 4. The telescopic-leg assembly is mounted inside one of the case sides as depicted in FIG. 1 and is held secure through the holes as described.

A U-shaped hollow housing member 22, shown best in FIGS. 7 and 19, consists of a pair of sides designated leg retaining hollow housings 24 and a center portion or a catch housing 26 connected together with joining means. These joining means consist of a pair of hollow structural elbows 28 having a diameter that allows a press fit to be made into the hollow inside diameter of both the leg retaining housings 24 and the catch housing 26. The elbows 28 are illustrated in FIGS. 7, 14, 15 and 20 and when pressed together form the basic structural housing member 22.

The main support for the case 20 is provided by a pair of pedestal legs 30 that are slideably mounted inside each leg retaining housing 24. The legs 30 have a straight section 32 and a hinged pivoted section 34 which form a pair of inverted V-shaped legs 30 that become a stand with four distinct legs when extended from the case 20. The straight section 32 is round at the top and half round the balance of its length as shown in cross section in FIGS. 12 and 14. The hinged pivotal section 34 is configured with a mating half round cross section the entire length as depicted in FIG. 14. This configuration allows both leg sections 32 and 34 to penetrate and be retained by the housing 24 when pivoted together. Both the straight and pivoted sections 32 and 34 preferably have radiused ends 36 and optionally resilient tips 38, as shown in FIGS. 12 and 13, in the form of inserts, a pliable thermoplastic material deposited on the ends, or any other type of material well known in the art.

Figure 21:
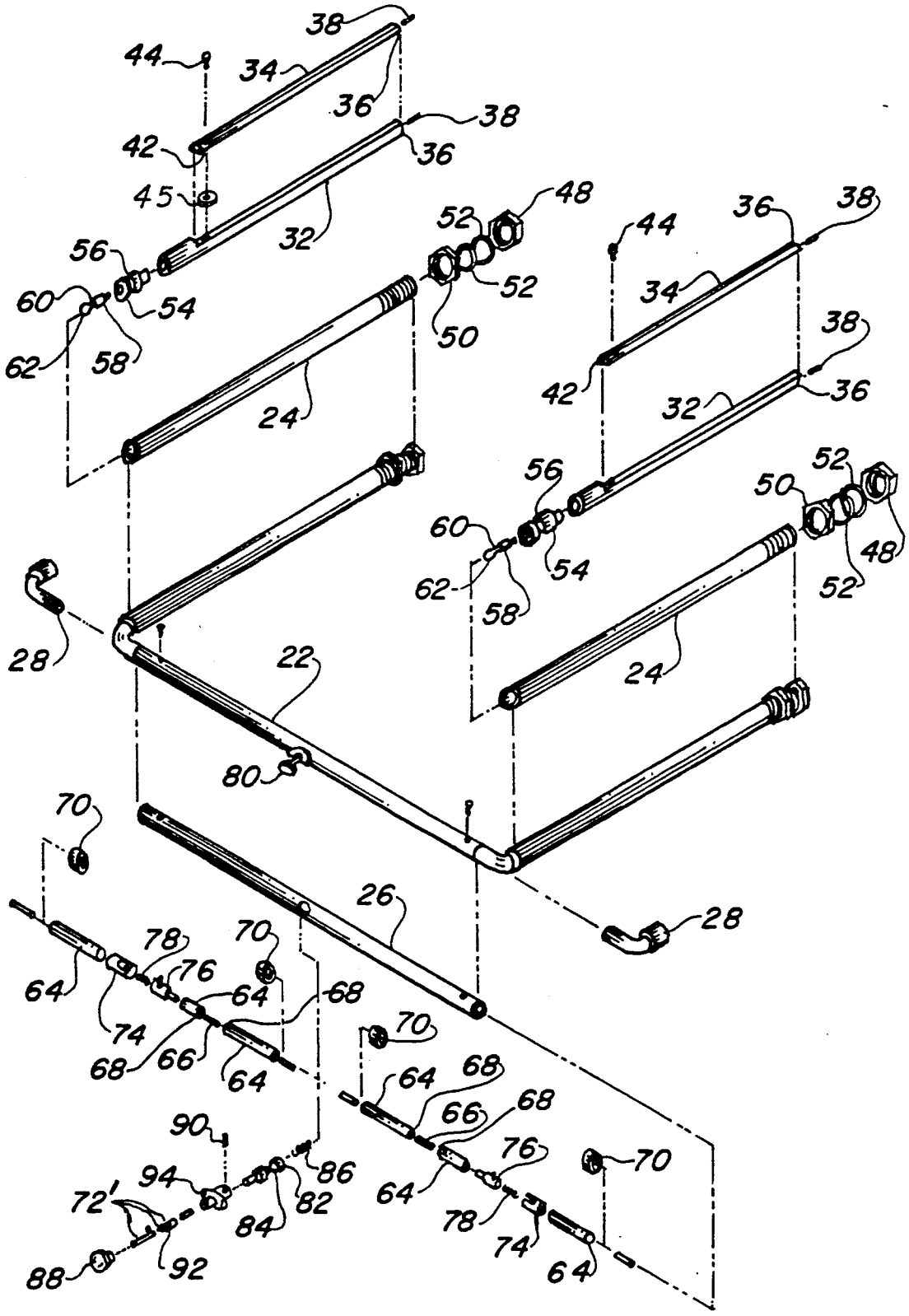
FIG. 21 is an exploded view of the invention removed from the briefcase.

The round end of the straight leg section 32 contains a socket 40, preferably threaded, for receiving further components. This leg 32 also contains a flat 42 on one edge of the half round portion for indexing. The hinged pivotal leg section 34 along with the half round configuration has stop means in the form of a pin 44 or a flat 42 on the end nested into the straight leg section 32, restricting the pivotal orientation when the legs separate to form the V-shaped stand. The pedestal legs 30 may also include a leg pivot-dampening means that allows the pivotal leg section 34 to angularly rotate at a controlled speed. One such dampening means may consist of a friction washer 45 placed at the hinge axis between the straight section 32 and the pivoted section 34 as shown in FIG. 21. In an optional embodiment, each pair of legs 30 have a spring 46 integral with the pivot joint such that the pivotal sections 34 are formed into angular rotation when extended under the influence of the spring. FIG. 20 illustrates this option and its function is to allow the legs to split open automatically when extended, however, they must be manually closed when retracted.

Attaching, retaining and positioning means fasten the housing member 22 to the case 20, retain the legs 30 in the housing member and position the legs relative to the housing allowing uniform placement when the legs are angularly extended. This function is accomplished using a cap 48 threadably attached to the open ends of each leg retaining housing 24. The cap 48 has a hole in the end slightly larger than the combined legs 30 with a flat 42' mating with the one on the legs as previously described. The element attached to the socket 40 in the leg 32, explained later, is larger in diameter than the hole in the cap 48 allowing the cap to retain the leg 30. Since the cap 48 is fixably attached to the housing 22 and the housing penetrates the holes in the briefcase 20, the cap becomes a structural barrier on the outside. The flat 42' in the hole in the cap restricts the leg 30 from rotating thereby assuring proper alignment when the legs are split open when extended from the housing 22. Additionally, on the most outward flat of the cap 48 may be located a notch 49, as shown in FIGS. 7 and 17. The notch is sized to allow the outward edge of the pivotal section leg 34 to fall into and be held by the notch 49. Thus, further preventing the pivotal leg from rotating when the case is set on a surface. A pair of locknuts 50, one on each housing 24, are threadably disposed on the end of the housing above the cap 48 thus allowing captivation with the briefcase 20 therebetween. A pair of O-rings 52 may be inserted between the cap 48 and case 20 on one side and the case 20 and locknut 50 on the other. The O-ring creates a watertight seal and prevents maring of the case 20 when threaded together to form the attachment. Other means of captivating the device inside the case may be used without limiting the scope of the invention.

A piston 54 is attached to the fully round end of each straight section leg 32 and into the socket 40 by pressing, bonding with adhesive, welding, brazing, pinning etc. with threading being preferred. The piston is slightly smaller in diameter than the hollow leg retaining housing 24 in which the entire leg 30 is slideably contained but larger than the hole in the cap 48. This sizing allows the leg to descend slowly and evenly from the housing when released as it forms a slight vacuum within the housing. The diameter is so selected as to allow this action to occur at the optimum rate of travel or speed giving the invention the feel of a controlled function. The piston 54 may further contain a groove 56 for collecting unwanted dirt and grit so as not to affect the function of the vacuum created by the movement of the piston 54 within the housing 24.

A keeper 58 is connected to each piston 54 on the exposed end again by any known means such as threading. The keeper 58 contains a concave surface 60 and a radial extended end 62 for receiving contiguous attachments. This shape, in the form of a ball on a pedestal, is preferred however, other configurations will function equally well such as a tapered end and a groove or recess below the end or a myriad of other configurations. Any rate, the shape allows containment and release of the legs 30 by forcing a member into the concave surface and disconnection to extend the leg. It is preferable that this keeper 58 be fabricated of a hard non-wearing metal such as steel possibly heat treated for hardening allowing repeated usage without undue wear. The keeper 58 is illustrated in FIGS. 10 and 11 completely removed from the invention for clarity and is depicted in the preferred embodiment with the radial extended end as described above.

A pair of catch rods 64 shown best in FIGS. 17–19 are slideably contained within the catch housing 26, one on each end and contiguously interface with the concave surface 60 of the keeper 58 holding the legs 30 in place. While unnecessary for the invention, but to accommodate the variable length of different briefcases adjustment means in the form of a threaded stud 66 may be inserted into the rod 64 using mating threaded sockets 68 interfacing therewith. This arrangement allows the two-piece rod 64 to be rotated oppositely to obtain an exact length. A spring loaded expansion joint 72 may be alternately used for adjustment or may be used in conjunction with the studs 66 and sockets 68. This joint is depicted in FIG. 19 and expanded in FIG. 21 and consists of a ferrule 74 connected to the rod 64 over a plunger 76 with a compression spring 78 inbetween. The plunger 76 may be either a separate element or the end of the rod itself as shown in FIG. 19. The spring 76 allows constant pressure to be directed outward until the spring is in a relaxed position or a pin and slot may be employed for containment and limited movement in either direction. Further, a number of bushings 70 may be inserted over the rod 64 for positioning the rod in the center of the housing 26 assuring smooth linear movement of the rods. These bushings 70 may be made of any material such as thermoplastic or the like with DELRIN being preferred.

The catch means best illustrated in FIGS. 16, 18 and 21 is employed that interfaces with the rods 64 allowing the legs 30 to be retained in the housing 22 and when actuated, allowing the legs to extend and form a self supporting stand. This catch means consists of the above described catch rods 64 inside the catch housing 26 with a spring loaded catch pushbutton actuator 80 having a rounded end 82 and a depression 84 adjacent thereto, disposed between the rods 64. A catch actuator spring 86 provides the positioning means to hold the actuator 80 in contact with tips of the rods thereby maintaining contact with the concave surface 60 of the keeper 58 on the other end of the rods. When the actuator 80 is depressed, the rods 64 enter the depression 84 shortening their length permitting the legs 30 to be released and slide outward from the briefcase by gravity. A knob 88 is affixed to the actuator 80 providing an adequate surface area for comfort of the operator. If desired, however not essential for the invention, an expansion joint 72' may be utilized to eliminate wear. The joint is similar to those used on the rods 64 except a pin 90 and slot 92 is required in the ferrule 74 to limit travel in both directions. For strength and exact positioning, a saddle 94 is utilized forming a structural interface with the catch housing 26. This saddle 94 is attached to the housing with a threaded fastener and is illustrated best in FIGS. 16 and 21.

While unnecessary for the invention, however to improve appearance, the case 20 may be modified by cutting or forming a recess 96 around the actuator 80 where it protrudes and initially an escutcheon plate 98 covering the recess permitting the actuator knob 88 to be flush with the case. FIG. 1 depicts this embodiment and FIGS. 4 and 5 illustrate the knob 88 simply protruding through a hole in the case 20.

The assembly 10 may be made of any material suitable for the application having sufficient structural integrity such as plastic, wood, composites, etc. however, aluminum is preferred for the housing member 22, legs 30, pistons 54, elbows 28 and plastic for the locknuts 50, bushings 70, and button knob 88.

In operation, the briefcase 20 is held by the handle and the knob 88 is pushed thus releasing the legs 30. When the legs are fully extended after the slow controlled release, the user tilts the case forward allowing the hinged legs 34 to rotate downward and lock the legs from retracting. The case is then rested on the surface using all four legs allowing opening if desired. When the case is to be put away, the briefcase is closed and lifted slightly by the handle allowing the legs 32 and 34 to rotate together by gravity. The case is then placed on the floor while still holding the handle, permitting the legs to be retracted and snap into place in the housing 26. If the optional embodiment is used employing the spring 46 between the legs, both legs 32 and 34 must be manually rotated together and started into the retaining housing 22 before setting the case on the floor.

While the invention has been described in complete detail and pictorially shown in the accompanying drawings, it is not to be limited to such details, since many changes and modifications may be made to the invention without departing from the spirit and the scope thereof. For example, the assembly 10 can be designed to operate in combination with electronics/electrical devices or fluidic devices. Hence, it is described to cover any and all modifications and forms which may come within the language and scope of the claims.

We claim:

1. A unitized telescopic-leg assembly for supporting a hand carried case of the type having two sides, where said assembly is contained within one side of said case and comprises:

a) a U-shaped hollow housing member having ends and center portion disposed within the case, said housing further comprising:

(1) a pair of leg retaining housings having a first end and a second end, with the first end attached through the case, and (2) a catch housing attached angularly to the second end of the legs forming the U-shape, b) a pair of legs each having a straight and a pivotal section slidingly mounted within each end of the housings such that each pivotal section rotates angularly when extended forming four distinct weight bearing legs for supporting the case, and allowing the case, with said legs extended, to be set on a surface prior to opening or closing the case, wherein said straight section of said legs further comprises a half round cross section extending through part of its length and said pivotal section having a mating half round cross section throughout its length allowing the entire leg to penetrate and be retained by the housing when pivotally juxtapositioned therewith, c) a piston, having a keeper thereon, connected to each leg, the piston slightly smaller than the hollow housing permitting each leg to slowly extend utilizing gravity by forming a slight vacuum within the housing, and d) catch means interfacing with the piston keeper retaining the legs inside the housing and when actuated releasing the legs thus extending to form a self supporting stand.

2. A unitized telescopic-leg assembly for supporting a hand carried case of the type having two sides, where said assembly is contained within one side of said case and comprises:

a) a U-shaped hollow housing member having ends and center portion disposed within the case, b) a pair of legs each having a straight and a pivotal section slidingly mounted within each end of the housing such that each pivotal section rotates angularly when extended forming four distinct weight bearing legs for supporting the case, c) a piston, having a keeper thereon, connected to each leg, the piston slightly smaller than the hollow housing permitting each leg to slowly extend utilizing gravity by forming a slight vacuum within the housing wherein said piston further comprises a groove for collecting unwanted dirt and grit so as not to affect the function of the vacuum created by the movement of the piston within the housing, and said keeper having a concave surface therein and a radial extended end allowing the catch to be overcome when the leg is fully retracted within the housing retaining the legs and released from the groove when the catch is actuated withdrawing interface with the keeper's concave surface extending the legs, and d) catch means interfacing with the piston keeper retaining the legs inside the housing and when actuated releasing the legs thus extending to form a self supporting stand.

3. A unitized telescopic-leg assembly for supporting a hand carried case of the type having two sides, where said assembly is contained within one side of said case and comprises:

a) a U-shaped hollow housing member having ends and center portion disposed within the case, b) a pair of legs each having a straight and a pivotal section slidingly mounted within each end of the housing such that each pivotal section rotates angularly when extended forming four distinct weight bearing legs for supporting the case, c) a piston, having a keeper thereon, connected to each leg, the piston slightly smaller than the hollow housing permitting each leg to slowly extend utilizing gravity by forming a slight vacuum within the housing, and d) catch means interfacing with the piston keeper retaining the legs inside the housing and when actuated releasing the legs thus extending to form a self supporting stand, wherein said catch means further comprises a pair of catch rods and a spring loaded catch push button actuator, the catch rods disposed within the center portion of the housing and the actuator in the middle, with the actuator allowing the catch rods to be retracted to the middle when the actuator is urged inwardly withdrawing the interface with the piston keepers.

4. A unitized telescopic-leg assembly for supporting a hand carried case of the type having two sides, where said assembly is contained within one side of said case and comprises:

a) a U-shaped hollow housing member having ends and center portion disposed within the case, b) a pair of legs each having a straight and a pivotal section slidingly mounted within each end of the housing such that each pivotal section rotates angularly when extended forming four distinct weight bearing legs for supporting the case, c) a piston, having a keeper thereon, connected to each leg, the piston slightly smaller than the hollow housing permitting each leg to slowly extend utilizing gravity by forming a slight vacuum within the housing and d) catch means interfacing with the piston keeper retaining the legs inside the housing and when actuated releasing the legs thus extending to form a self supporting stand, e) an attaching, retaining and positioning means to fasten the housing to the case, retain the legs therein and position the legs allowing uniform placement when angularly distended, wherein the attaching, retaining and positioning means further comprises:

(1) said straight leg having a flat longitudinally positioned thereupon, (2) said pistons are larger than the legs, (3) a cap on each housing having a hole with a flat in the end thereof with the hole slightly larger than the legs and smaller than the piston, the cap fixably attached to the housing creating a combined stop to retain the legs due to the larger size of the piston while positioning each leg by the complementary flat on both the leg and cap also creating a mounting surface interfacing with the case, and (4) a pair of locknuts threadably disposed on the housing interposing the case between the cap and the locknut defining the positioning means.

5. A unitized telescopic-leg assembly for supporting a hand carried case of the type having two sides, where said assembly is contained within one side of said case and comprises:

a) a U-shaped hollow housing member having ends and center portion disposed within the case, b) a pair of legs each having a straight and a pivotal section slidingly mounted within each end of the housing such that each pivotal section rotates angularly when extended forming four distinct weight bearing legs for supporting the case, c) a piston, having a keeper thereon, connected to each leg, the piston slightly smaller than the hollow housing permitting each leg to slowly extend utilizing gravity by forming a slight vacuum within the housing and d) catch means interfacing with the piston keeper retaining the legs inside the housing and when actuated releasing the legs thus extending to form a self supporting stand, and e) an attaching, retaining and positioning means to fasten the housing to the case, retain the legs therein and position the legs allowing uniform placement when angularly distended, wherein the attaching, retaining and positioning means further comprises:

(1) said straight leg having a flat longitudinally positioned thereupon, (2) said pistons are larger than the legs, (3) a cap on each housing having a hole with a flat in the end thereof with the hole slightly larger than the legs and smaller than the piston, the cap fixably attached to the housing creating a combined stop to retain the legs due to the larger size of the piston while positioning each leg by the complementary flat on both the leg and cap also creating a mounting surface interfacing with the case, wherein said cap further comprises on its most outward flat a notch that is sized to allow the outward edge of said pivotal section leg to fall into and be held by said notch to prevent said pivotal leg from rotating when said case is set on a surface, (4) a pair of locknuts threadably disposed on the housing interposing the case between the cap and the locknut defining the positioning means.

6. A unitized telescopic-leg assembly for supporting a hand carried case of the type having two sides, where said assembly is contained within one side of said case and comprises:

a) a U-shaped hollow housing member having ends and center portion disposed within the case, b) a pair of legs each having a straight and a pivotal section slidingly mounted within each end of the housing such that each pivotal section rotates angularly when extended forming four distinct weight bearing legs for supporting the case, wherein said legs further comprise a leg pivot-dampening means that allows said pivotal leg section to angularly rotate at a controlled speed, c) a piston, having a keeper thereon, connected to each leg, the piston slightly smaller than the hollow housing permitting each leg to slowly extend utilizing gravity by forming a slight vacuum within the housing and d) catch means interfacing with the piston keeper retaining the legs inside the housing and when actuated releasing the legs thus extending to form a self supporting stand.

7. A unitized telescopic-leg assembly for supporting a hand carried case having a handle and two hinged sides allowing opening of the case in a clam shell manner where said assembly comprises:

a) a pair of leg retaining round hollow housings attachably disposed within one side of the case, b) a pair of straight section pedestal legs having a first and a second end with the legs slideably mounted inside each leg retaining housing, c) a hinged section pivotal leg attached to each pedestal leg forming a pair of V-shaped legs defining a weight bearing stand when extended from the case, d) attaching, retaining and positioning means fastening the housings to the case, retaining the legs therein and position the legs allowing uniform placement when angularly distended, e) a piston attached to the first end of each pedestal leg, the piston slightly smaller than the hollow leg housing allowing each leg to extend slowly by forming a slight vacuum within the housing, f) a keeper connected to each piston opposite the leg, the keeper having a concave surface therein and a radial extended end for contiguous attachment thereunto, g) a catch housing having connecting means joining the leg housings to the catch housing forming a U-shaped housing member, h) a pair of catch rods disposed within the catch housing, one on each end, contiguously interfacing with the concave surface of each keeper holding the legs in place, and i) a spring loaded catch push button actuator having a rounded end and a depression adjacent thereto with the spring holding the actuator end in contact with the catch rods and when manually depressed allowing the catch rods to enter the depression releasing the rods from contact with the keeper permitting the legs to extend by gravity and form a self supporting stand.

8. The assembly as recited in claim 7 wherein the case further comprises a recess therein adjacent to the push button actuator and a escutcheon plate covering the recess allowing the actuator to be flush with the outside contour of the case.

9. The assembly as recited in claim 7 wherein said pedestal legs further comprise a half round portion with radiused ends on one extremity and a round section on the other having a socket to receive the piston with a flat on one edge of the half round portion.

10. The assembly as recited in claim 7 wherein said hinged pivotal leg further comprises a half round configuration the entire length having stop means attached thereto with the pivotal leg nesting with the pedestal leg such that the pair become round allowing storage within the hollow housings and the stop means interface with the pedestal leg such that the legs are restricted in their pivotal orientation to form a V-shaped stand.

11. The assembly as recited in claim 7 wherein said attaching, retaining and positioning means further comprise; said pistons are larger in size than the legs, a cap on each housing having a hole with a flat in the end thereof with the hole slightly larger than the combined pedestal and pivotal leg, the cap fixably attached to the housing creating a combined stop to retain the legs due to the larger size of the piston and positioning each leg by the complementary flat on both the leg and cap also creating a mounting surface interfacing with the case, and a pair of locknuts threadably disposed on the housing interposing the case between the cap and the locknut defining the positioning means.

12. The assembly as recited in claim 7 wherein said piston further comprises a groove for collecting unwanted dirt and grit so as not to affect the function of the vacuum created by the movement of the piston within the housing.

13. The assembly as recited in claim 7 wherein said keeper is formed of a hard non-wearing substance capable of being contiguously urged by the catch rods on a repeated basis.

14. The assembly as recited in claim 7 wherein said connecting means joining the catch housing to the leg housings further comprise a pair of hollow structural elbows having a diameter allowing a press fit into the hollow of the leg retaining housings and the catch housing.

15. The assembly as recited in claim 7 wherein each catch rod further comprises:

a) an adjustment means to change the length of each rod to accommodate the width of the specific hand carried case and to properly interface with the keeper and catch push button actuator, b) a plurality of bushings on each rod for positioning and allowing linear movement inside the hollow catch housing, and c) a spring loaded expansion joint to maintain tension on the keeper.

16. The assembly as recited in claim 7 wherein said push button actuator further comprises:

a) a saddle forming a structural interface with the catch housing allowing the actuator to move freely therein, b) a knob external to the case providing an extended surface for convenience, and operator comfort and c) a spring loaded expansion joint to maintain tension between the actuator and the catch rods.

17. A unitized telescopic-leg assembly for supporting a hand carried case having a handle and two hinged sides, said assembly comprising:

a) a U-shaped hollow housing member having ends and a center portion disposed within one side of the case, b) a pair of legs each having a straight and pivotal section slidingly mounted within each end of the housing, each pair of legs further having a spring between the sections such that each pivotal section rotates angularly under the influence of the spring when extended forming four distinct weight bearing legs for supporting the case, c) a piston, having a keeper thereon, connected to each leg, the piston slightly smaller than the hollow housing allowing each leg to extend slowly by forming a slight vacuum within the housing, and d) a catch interfacing with the piston keeper retaining the legs inside the housing and when actuated releasing the legs to extend and form a self supporting stand.

* * * * *